United States Patent [19]

Dunsmuir et al.

[11] Patent Number: 4,801,476

[45] Date of Patent: Jan. 31, 1989

[54] METHOD FOR PRODUCTION OF LARGE AREA 2-DIMENSIONAL ARRAYS OF CLOSE PACKED COLLOIDAL PARTICLES

[75] Inventors: John H. Dunsmuir, Annandale; Harry W. Deckman, Clinton; James A. McHenry, Washington, all of N.J.

[73] Assignee: Exxon Research and Engineering Company, Florham Park, N.J.

[21] Appl. No.: 93,010

[22] Filed: Sep. 3, 1987

Related U.S. Application Data

[63] Continuation-in-part of Ser. No. 911,020, Sep. 24, 1986, abandoned.

[51] Int. Cl.[4] ..... B05D 1/20

[52] U.S. Cl. ..... 427/430.1; 427/434.3; 427/443.2; 118/402; 118/422

[58] Field of Search ..... 427/430.1, 434.3, 443.2; 118/402, 403, 422; 264/298

[56] References Cited

U.S. PATENT DOCUMENTS

| | | | |
|---|---|---|---|
| 2,220,860 | 11/1940 | Blodgett | 428/316.6 |
| 3,485,658 | 12/1969 | Iler | 429/328 |
| 3,657,003 | 4/1972 | Kenney | 427/443.1 X |
| 4,204,933 | 5/1980 | Barlow et al. | 427/74 X |
| 4,404,255 | 9/1983 | Peiffer et al. | 427/214 X |
| 4,407,695 | 10/1983 | Deckman et al. | 427/198 X |
| 4,511,604 | 4/1985 | Barraud et al. | 427/434.3 X |
| 4,560,599 | 12/1985 | Regen | 427/407.1 X |
| 4,632,800 | 12/1978 | Barraud et al. | 118/402 X |
| 4,681,799 | 7/1987 | Engel | 528/266 X |

OTHER PUBLICATIONS

Hawley; "Condensed Chemical Dictionary"; Van Nostrand Reinhold Co.; 1971; pp. 228, 268, 346, 840, and 936.

*Primary Examiner*—Shrive Beck
*Assistant Examiner*—Alain Bashore
*Attorney, Agent, or Firm*—Ronald D. Hantman

[57] ABSTRACT

A method is described which details the preparation of large area close packed monolayers of colloidal particles from random distributions of colloidal particles by compressing the random network.

12 Claims, 5 Drawing Sheets

1μm

10μm

10μm

10μm

10 μm

1 μm

METHOD FOR PRODUCTION OF LARGE AREA 2-DIMENSIONAL ARRAYS OF CLOSE PACKED COLLOIDAL PARTICLES

CROSS REFERENCE TO RELATED APPLICATIONS

This application is a continuation-in-part application of copending Ser. No. 911,020, filed Sept. 24, 1986, now abandoned.

BACKGROUND OF THE INVENTION

Coatings of precisely ordered colloidal particles on solid surfaces are useful in many areas of science and technology. Randomly arranged colloidal particle coatings have been shown to be useful for interference and antireflection coatings (Iler, U.S. Pat. No. 3,485,658) and for tamper layers in fusion targets (Peiffer and Deckman, U.S. Pat. No. 4,404,255). Ordered arrays of colloidal particles coated on surfaces are useful either as a diffraction grating, an optical storage medium or an interference layer. Monolayer thick arrays of both random and ordered colloidal particles have been shown to be usable as a lithographic mask for the preparation of precisely controlled surface textures (Deckman and Dunsmuir, U.S. Pat. No. 4,407,695). Surface textures lithographically prepared from colloidal particle monolayers can contain uniformly sized microstructures over large areas, which are difficult to prepare with conventional lithographic techniques. Uses for uniformly sized, large area surface textures include selective solar absorbers, Craighead et al, U.S. Pat. No. 4,284,689, optical gratings and optically enhanced solar cells (Deckman et al, U.S. Pat. No. 4,497,974). The present invention relates to a method for preparing densely packed colloidal particle coatings which are free of defects.

The technology of coating a substrate with a particular type of monolayer thick random array of colloidal particles is well known. Such coatings will be called random colloidal coatings and methods for producing them are described by Iler in U.S. Pat. No. 3,485,658, as well as in Iler, Journal of Colloid and Interface Science 21, 569–594 (1966); Iler, Journal of the American Ceramic Society 47 (4), 194–198 (1964); Marshall and Kitchener, Journal of Colloid and Interface Science 22, 342–351 (1966); and Peiffer and Deckman, U.S. Pat. No. 4,315,958. These coating techniques deposit a random array of colloidal particles on the substrate utilizing an electrostatic attraction. When the colloidal particles are electrostatically attracted to a substrate they adhere at the point where they strike the surface. Electrostatic attraction occurs because a surface charge opposite to that of the substrate is induced on the colloidal particles. In this type of colloidal monolayer particles are randomly arranged spaces will exist between most of the particles. Examples of spaces between particles in random colloidal coatings are shown in FIGS. 1 and 2. FIG. 1 is an electron micrograph showing the ordering of monodisperse spherical latex particles in a random colloidal coating. Spaces between particles are clearly apparent in the micrograph. FIG. 2 is an electron micrograph showing the ordering of 2 μm polystyrene latex particles in a random colloidal coating. The spaces between particles in random colloidal coatings arise from limitations on the number of particles that can diffuse to the surface to be coated and electrostatically adhere to form a monolayer. Random arrays are produced by immersing a substrate into a sol under conditions of Ph such that the surface of the substrate and the colloidal particles have charge of opposite sign. The colloidal particles diffuse through the sol to the substrate surface where the opposite charges interact to electrostatically bond the particle to the substrate. After the surface to be coated has achieved a given density of coverage of colloidal particles, which varies depending on the details of the coating process, the remaining uncoated surface is electrostatically screened by the presence of the adjacent adhered particles such that other particles diffusing to the surface are repelled back into the sol.

Formation of ordered colloidal particle arrays has been disclosed by Deckman and Dunsmuir, U.S. Pat. No. 4,407,695 (1983). In this process, ordered arrays of colloidal particles are formed by spin coating. Ordering of the particles occurs because the sol flows across the substrate at high shear rates while the excess coating material is being dispelled to produce densely packed microcrystalline arrays. The colloid must wet the substrate and spin speed must be optimized. If the spin speed is too low a multilayer coating will be produced and if the final spin speed is too high voids will occur in the monolayer coating. Other factors such as rheology of the sol, particulate concentration, substrate surface chemistry, and differential charge between substrate and colloid must be optimized for each particle size. A systematic method for optimizing these factors requires detailed understanding of the dynamics of the coating process which is not presently available. For spheres outside the 0.3–1.0 μm size range, optimization of the coating process can be quite difficult. Imperfections in particulate ordering include point defects, dislocations, and grain boundaries. The largest number of submicron spheres observed in a single crystallite is $10^5$ and typical grains contain 50–1000 spheres. FIG. 3 is an electron micrograph showing the microcrystalline ordering of spin coated monodisperse polystyrene latex particles. FIG. 3 shows packing defects on part of a 3 in. silicon wafer which was uniformly coated with microcrystalline arrays of $0.497 \pm 0.006$ μm spheres. The coating was prepared by flooding a surfactant cleaned wafer with polystyrene latex (Dow Diagnostics lot 1A27) containing 15 wt. % solids and spinning at 3400 rpm until dry.

The present invention describes a method for preparation of a third class of colloidal particle array with distinctly different properties from either ordered or random colloidal coatings. Most notable of these differences are control, the removal of empty spaces between particles that are found in random colloidal coatings, and the ability to produce either random or ordered coatings using a single coating technique.

SUMMARY OF THE PRESENT INVENTION

The present invention includes a method of producing a close packed coating of colloidal particles on a substrate. The method includes the steps of formating a monolayer of particles at a liquid-gas (may be air) interface, compressing the monolayers of particles on the liquid surface, removing the compressed layer of particles from the liquid surface onto a substrate, and drying the substrate.

DESCRIPTION OF THE PREFERRED EMBODIMENT

The present invention includes a method for producing a close packed coating of colloidal particles on a substrate. The method removes the intervening spaces between the colloidal particles.

These intervening spaces are removed by compressing a random colloidal layer on a liquid surface such that these spaces are squeezed out. This squeezing out process involves the following steps:

(1) formation of a monolayer of colloidal particles on a liquid surface.

(2) Compression of the random colloidal coating on the liquid surface by mechanical or chemical means.

(3) Removal of the compressed monolayer coating from the liquid surface onto either an original substrate or a new substrate.

(4) Drying the compressed layer on the substrate.

Figure 4:
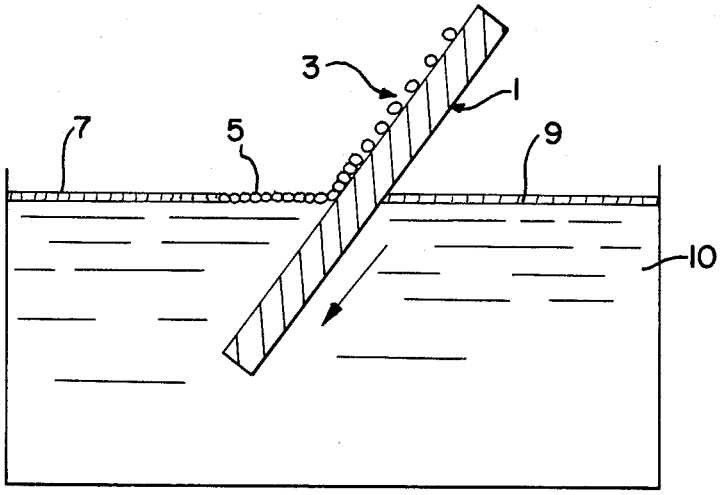
FIG. 4 shows the compression of a random colloidal coating as it is transferred from a substrate onto a liquid surface coated with a surfactant. A compressed monolayer is formed due to the action of the surfactant layer as a "piston oil" preventing spreading of the colloidal particles on the liquid surface.

Step 1 can be accomplished by slowly immersing a substrate coated with a monolayer thick colloidal coating through a liquid interface such that the colloidal layer is lifted off the substrate at the meniscus and is floated onto the liquid surface. A schematic representation of this process is shown in FIG. 4. As the substrate is passed through the liquid interface 9, colloidal particles are lifted off the substrate 1 by the water miniscus and trapped at the liquid interface 9. Step 1 can also be accomplished by spreading over the liquid surface a droplet containing colloidal particles suspended in a second liquid which is immiscible with the first liquid. The second liquid must be chosen so that it evaporates leaving a colloidal layer trapped at the liquid interface.

In the preferred embodiment, the liquid (10) used in step 1 is water. Most efficient trapping of colloidal particles at the water air interface occurs when the particle surface is made hydrophobic. The contact angle between the water and hydrophobic particle surface provides an extremely stable trap for colloidal particles. Hydrophobic colloidal particle surfaces can be created by treating them with silylating agents, amines having hydrophobic ends, and other functionalization agents. For example micron sized colloidal particles of ZK-5 zeolites can be made hydrophobic by washing them with hexamethyl disilazane (HMDS) or with n-benzyltrimethyl-ammonium hydroxide 40% in methanol. Excess washing agent can be readily removed by a physical separation such as filtration, centrifuging or decanting. The treatment leaves the zeolite particles functionalized with a chemically bound molecule monolayer.

The trapped colloidal particle monolayer differs in character considerably with Langmuir-Blodgett films (see for example K. B. Blodgett and I. Langmuir, Phys. Rev. 51 (1937) 964; K. B. Blodgett U.S. Pat. No. 2,220,860, 1940, G. G. Roberts, P. S. Vincett, W. A. Barlow, Phys. Technol. 12 (1981), 69. Langmuir-Blodgett films are prepared with at least one layer of amphiphilic molecules. Trapping of the molecules at the air/-water interface occurs because they have both hydrophobic and hydrophillic ends. The colloidal particles described by the present invention are not amphiphiles in that they do not possess both hydrophobic and hydrophillic character at either opposite or even adjacent sides of the particles. Trapping of colloidal particles at the air water interface occurs because of forces such as surface tension (see P. Pieranski, Phys. Rev. Lett. 45 (1980) 569). This trapping is fundamentally diiferent to that for amphiphilic molecules in that it does not rely on having hydrophobic and hydrophillic ends bridge the water interface.

Step 2 is accomplished by decreasing the area available to the monolayer coating on the liquid substrate by mechanical, i.e., a movable barrier on the liquid surface or chemical, i.e., the use of a "piston oil" deposited on the liquid surface. The molecules of the "piston oil" or the mechanical barrier impart a force on the colloidal particles, thus compressing the monolayer. When a piston oil is used, spreading of monolayer is inhibited because of surface tension of the piston oil layer 7. Materials which can be used as piston oils include, surfactants such as sodium lauryl sulfate, and oils. Surface tension of the piston oil layer must be sufficient to compress the colloidal particles so they do not float loosely on the liquid surface 9. When random colloidal layers are compressed with a piston oil layer, the random nature of the original film tends to be preserved. Compression of the monolayer at the liquid surface can be accomplished by either adding a piston oil layer after the particles are transferred onto the liquid surface 9 or by spreading the piston layer 7 before the particles are transferred to the liquid surface. FIG. 4 shows a schematic diagram of a random colloidal coating 3 which is compressed 5 by a piston oil layer 7 that was spread before the coating 3 is floated off the substrate 1. In this case steps 1 and 2 are accomplished simultaneously.

Figure 7:
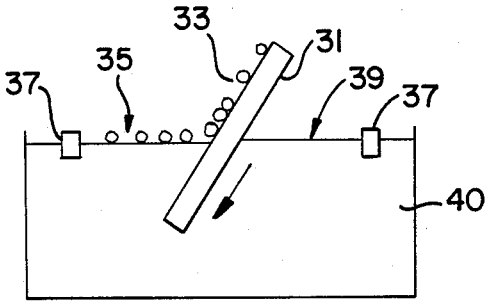
FIG. 7 shows a random colloidal coating being transferred from a substrate to a liquid surface. The colloidal particles are free to spread between physical barriers.
Figure 8:
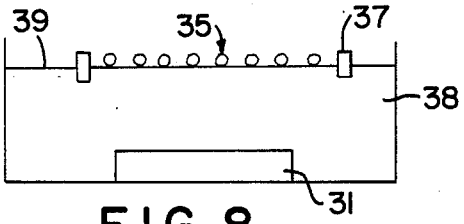
FIG. 8 shows a completely transferred colloidal layer with the substrate resting on the bottom of the liquid reservoir. The substrate can be removed by withdrawing it outside the barriers before further processing.
Figure 9:
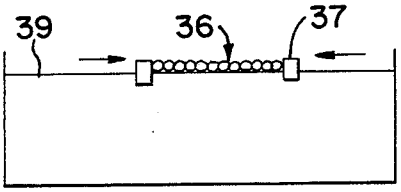
FIG. 9 shows a colloidal monolayer at the liquid surface being compressed by movement of a physical barrier to form a compressed monolayer.
Figure 10:
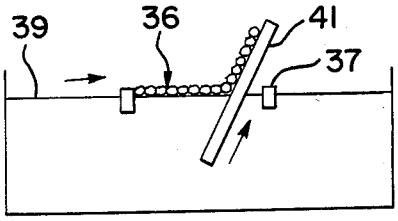
FIG. 10 shows a compressed monolayer being transferred to a substrate which is being withdrawn from under the liquid surface. The substrate can be introduced by lowering it underneath the liquid surface outside the confining physical barriers.

Compression of a monolayer 5 transferred to a liquid surface can also be performed with a mechanical barrier. FIGS. 7, 8, 9 and 10 illustrate the compression with a mechanical barrier of a colloidal monolayer trapped on a liquid surface. The colloidal monolayer must be transferred to a liquid surface which is not coated with piston oil as is shown in FIG. 7. A substrate 31 containing a random colloidal coating 33 is dipped between physical barriers 37 leaving a monolayer of colloidal particles 35 free to spread on the liquid surface 39. The substrate 31 may be removed, placed along one of the barriers or placed on the bottom of the liquid reservoir 38 as is shown in FIG. 8. A substrate on the bottom of the liquid reservoir can be easily removed by withdrawing it around the physical barriers. To compress the monolayer 35, the barriers are moved as is shown in FIG. 9. The compressed layer is transferred to a solid substrate 41 which is withdrawn from below the liquid surface as is shown in FIG. 10. By controlling the rate of compression with the mechanical barrier 37, a longer time is available for the polymer spheres to organize and more highly ordered layers may be obtained.

Such methods of compression have been previously used to prepare layers of surfactant molecules for Langmuir-Blodgett coating (see for example, K. B. Blodgett and I. Langmuir, Phys. Rev. 51 (1937) 964; K. B. Blodgett, U.S. Pat. No. 2,220,860, 1940; G. G. Roberts, P. S. Vincett, W. A. Barlow, Phys. Technol. 12 (1981) 69. Their use for compressing massive molecular aggregates (such as colloidal particles) into a stable film is without precedent.

When piston oils are used to compress monomolecular Langmuir-Blodgett layers, the piston oils is of the same size as the molecules being compressed. Also the molecular species compress so that only molecular sized holes exists between compressed molecules. For the compression of colloids, the molecules in the piston oil can be as small as one ten thousandth the colloidal particle diameter. Moreover, although the particles can touch at their diameters, the base of the particles in contact with the liquid can be spaced as much as 10,000 Å apart.

Figure 5:
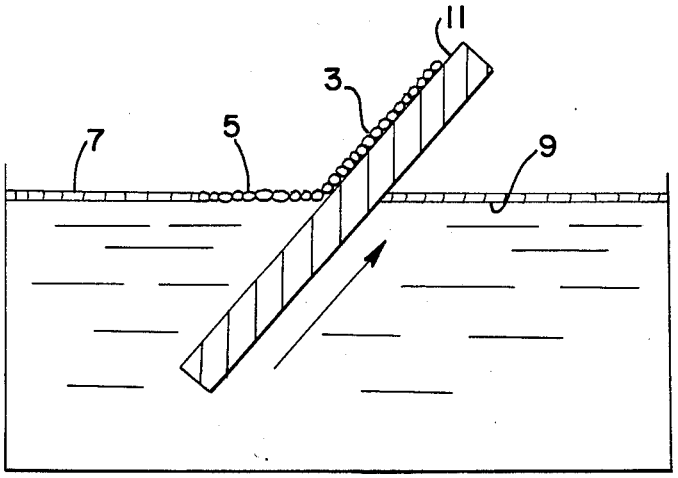
FIG. 5 is a schematic diagram showing the transfer of a compressed colloidal monolayer from a liquid surface onto a substrate withdrawn from the liquid to form a compressed colloidal monolayer on the substrate surface.

Step 3 is accomplished by placing the original substrate or a new substrate in the liquid phase beneath the surface and withdrawing the substrate such that the compressed layer is transferred from the liquid interface to the substrate surface, a schematic representation of which is shown in FIGS. 5 and 10. FIG. 5 is a schematic diagram showing the transfer of a compressed colloidal monolayer 5 from a liquid surface 9 onto a substrate 11 withdrawn from the liquid 10 to form a compressed colloidal monolayer on the substrate surface 13. FIG. 10 shows a compressed monolayer 36 being transferred to a substrate 41 which is being withdrawn from under the liquid surface 39. The substrate 41 can be introduced by lowering it underneath the liquid surface outside the confining physical barriers 37.

Figure 6:
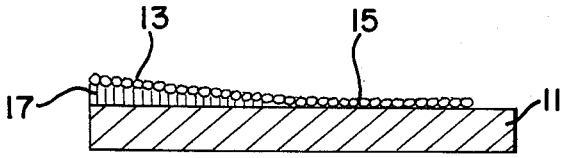
FIG. 6 shows a liquid layer remaining trapped between the substrate and colloidal monolayer when the layer is transferred in FIG. 5. The change in the coating as the liquid evaporates leaving a compressed colloidal coating is shown.

Step 4 is accomplished by allowing the residual water which is trapped between the substrate (17) and the compressed monolayer (13) to evaporate. The compressed random layer is now in intimate contact with the substrate (15). A schematic representation of this step is shown in FIG. 6. FIG. 6 shows that a liquid layer 17 remains trapped between the substrate 11 and colloidal monolayer 13 when the layer is transferred in FIG. 5. The change in the coating as the liquid 17 evaporates leaving a compressed colloidal coating 15 is shown.

Figure 1:
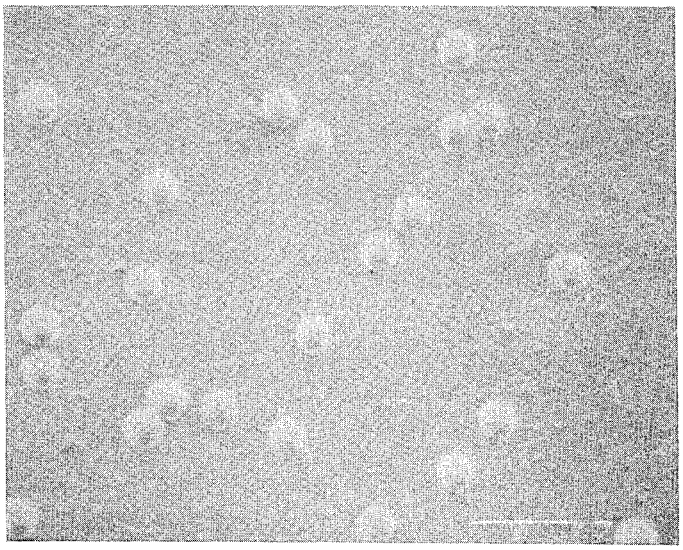
FIG. 1 is an electron micrograph showing the ordering of monodisperse spherical latex particles in a random colloidal coating. Spaces between particles are clearly apparent in the micrograph.
Figure 2:
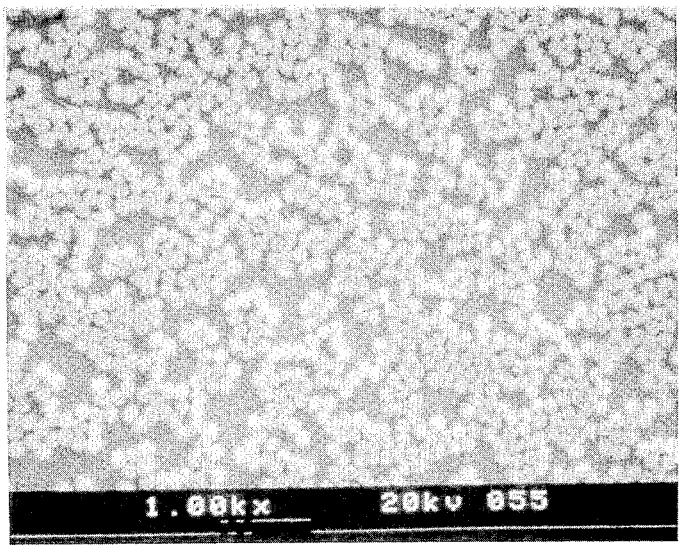
FIG. 2 is an electron micrograph showing the ordering of 2 m polystyrene latex particles in a random colloidal coating.
Figure 3:
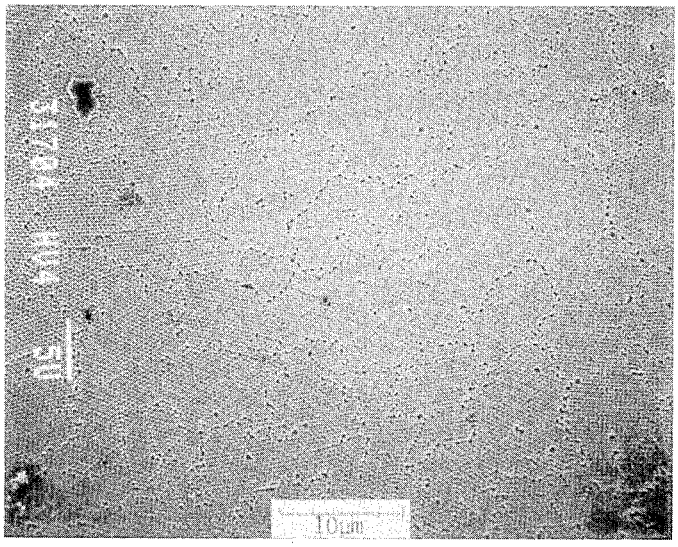
FIG. 3 is an electron micrograph showing the microcrystalline ordering of spin coated monodisperse polystyrene latex particles.
Figure 11:
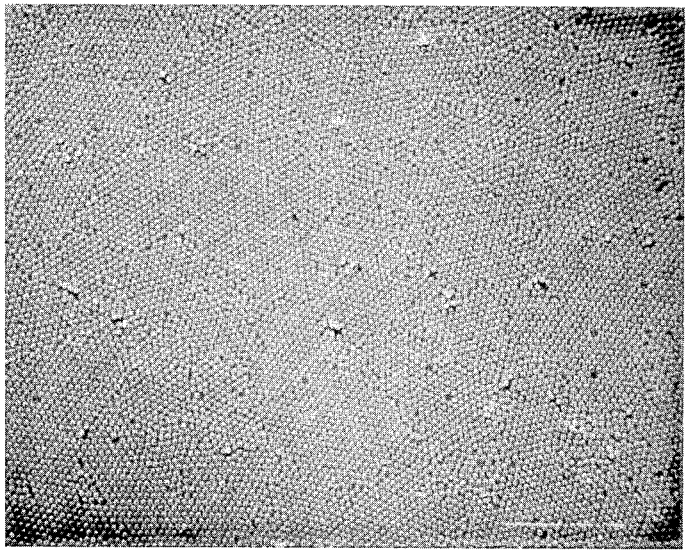
FIG. 11 is an electron micrograph showing the type of close packed ordered structure which can be obtained with the present invention.
Figure 12:
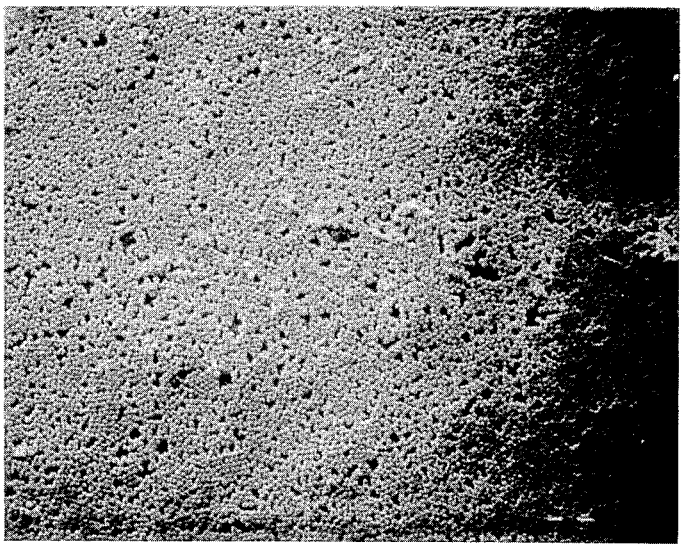
FIG. 12 is an electron micrograph showing another type of close packed structure which can be obtained with the present invention.

Monolayers formed by this method can exhibit a local close packed structure. FIGS. 11 and 12 are an electron micrograph showing the type of close packed random structure which is obtained using the present method. Vacancies large enough to accommodate single colloidal particles are generally absent the coatings shown in FIGS. 11 and 12. Differences in the nature of the local ordering in FIGS. 11 and 12 are due to the way in which the monolayer was compressed. Due to the random structure of the initial colloidal monolayer prior to compression, some vacancies (usually associated with dust or other impurities) are still present in the compressed film; however, surface coverage $>98\%$ of available surface sites can routinely be obtained. In random colloidal coatings a large number of vacancies (see FIG. 1) arise from limitations on the number of particles that can diffuse and adhere to the surface to be coated. After the surface to be coated has achieved a given density of colloidal particle coverage which varies depending on details of the colloidal coating process, the remaining uncoated surface is electrostatically screened by the presence of the adjacent adhered particles such that other particles diffusing to the surface are repelled back into the sol. These vacancies are eliminated in coatings formed from monolayers compressed on the surface of a liquid.

FIGS. 11 and 12 show some of the types of close packed structure which is obtained using the present invention. These structures range from random close packing to well defined periodic local ordering. Vacancies large enough to accommodate single colloidal particles are generally absent in the coatings. The present invention enjoys the additional advantages:

(1) the colloidal particle layer on the liquid surface can be patterned yielding a precisely shaped deposit on the final substrate;
(2) multilayers can be built up on a substrate by sequentially repeating steps 1–4;
(3) that the substrate need not be spun at high speed to produce a close packed monolayer;
(4) substrates that cannot be readily coated by colloidal processes such as nonwater wet materials may be coated with dense packed colloid by this method;
(5) the area to be coated can be very large and is limited only by equipment size;
(6) the requirement that the colloid be monodisperse can easily be relaxed. Close packed coatings of colloid particles of significant polydispersity may be obtained by this method.

In accordance with the invention, coatings consisting of monolayers of colloidal particles are formed by suspending colloidal particles at the surface of a liquid. Monolayers of colloidal particles can be stably trapped on the liquid surface and when compressed on the liquid surface film acquire elastic properties reminiscent of thin solid polymer films. Due to stability of the colloidal particle layer at the liquid surface, particles will in general not be introduced into the bulk liquid. To avoid introducing defects into the final film, it is preferred that the concentration of particles in the bulk liquid be less than 1% (by volume). In a more preferred embodiment, the particle concentration in the bulk liquid is less than $10^{-3}$% (by volume).

Colloidal particles can be grouped into patterns on the liquid surface by either transferring a prepatterned random colloidal coating onto the liquid surface or by dicing apart a compressed colloidal layer on the liquid surface.

To prepattern a random colloidal coating, a pattern is deposited which acquires a surface charge opposite to the colloid. The substrate onto which the pattern is coated must acquire a surface charge of the same sign as the colloid. The aforementioned surface charge is created by the surface chemistry of the colloid and for colloids suspended in water is due to hydroxylation-hydrogenation equilibrium. (See Iler, U.S. Pat No. 3,485,658 as well as Iler, J. Colloidal and Interface Science, 21, 569–594 (1966)). Patterning of the film deposited to attract the particles can be performed using lithographic processing techniques such as those described in "Thin Film Processes" edited by J. L. Vossen and W. Kern (Academic Press, New York 1978).

For most applications, the most convenient colloidal particles are polymeric spheres, e.g., polystyrene, polydivinyl-benzene, and polyvinyl-toluene. Such spheres are usually made by either suspension or emulsion polymerization, and can be conveniently fabricated in sizes ranging from 200 Å to 25 microns. Coatings of these particles can be fabricated on any size substrate which can be immersed in the liquid. Multilayer coatings of these particles can be formed by sequentially repeating the four basic steps involved in the coating process: (1) transferring a monolayer of colloidal particles onto a liquid surface, (2) compressing the monolayer, (3) transferring of the compressed layer onto a substrate and (4) drying the compressed layer onto the substrate.

Practice of the invention is illustrated in detail in the following examples.

EXAMPLE 1

A compressed layer is formed at a water air interface from a random colloidal coating of 0.5 m spherical polystyrene particles. The random colloidal coating is formed on a flat glass substrate using a process disclosed by Iler in U.S. Pat. No. 3,485,658. Specifically, the flat glass substrate is first immersed in an alumina sol (100 Å particle size) at Ph 5 1% solids, rinsed in distilled, deionized water and dried in $N_2$. The alumina coated glass is then immersed in a polymer colloid containing spherical particles in the range 10 to 30 wt. % at Ph=5. The substrate is then rinsed in distilled deionized water and dried in $N_2$. This process results in an under dense random coating of spherical polymer particles.

To transfer the random colloidal coating from the glass substrate to the water surface, the substrate is slowly (1 cm/sec) passed the water surface. Angle between the substrate and water surface was approximately 30 degrees. To efficiently transfer the layer, it is preferred that the colloidal layer be dipped shortly after it is made, and in this case the random colloidal coating was dipped 30 minutes after it was formed. Because of impurities in the random colloidal coating the monolayer transferred to the water surface will often tend to compress. This compression is due to a "piston oil" effect from the impurities. To fully compress the layer a drop of surfactant (sodium lauryl sulfate) was added to the water surface after the random colloidal coating was floated off the substrate. The compressed layer is transferred to a water insoluble glass surface by withdrawing that surface from beneath the water interface as is shown schematically in FIG. 5. A layer of water remains trapped between the compressed monolayer and substrate surface. This layer is removed by allowing the water to evaporate in air leaving the compressed monolayer in contact with the substrate surface. The coating may then be used directly or as a template for further coating or etching processes such as vacuum evaporation or plasma or ion beam coating.

EXAMPLE 2

A random colloidal coating of 0.5 micron spherical polystyrene particles was formed on a glass substrate using the method described in Example 1. The coating was transferred onto a water surface which was precoated with a piston oil layer as is shown schematically in FIG. 4. The piston oil layer was chosen to be sodium lauryl sulfate.

EXAMPLE 3

Figure 13:
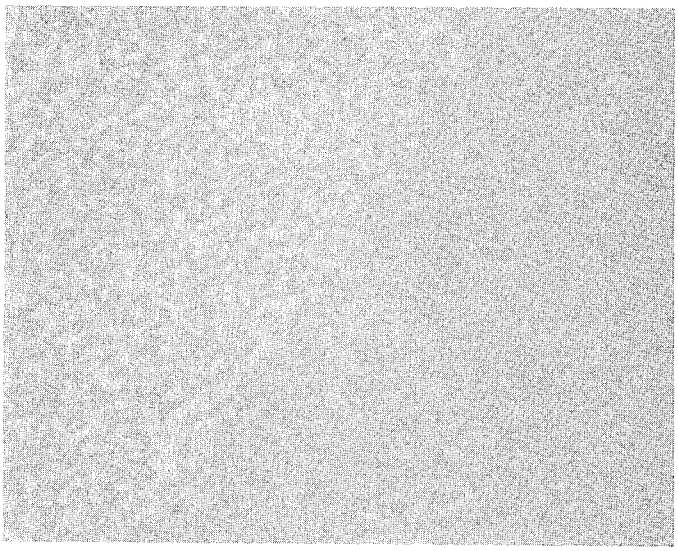
FIG. 13 is an electron micrograph of the interface between a random colloidal coating and a compressed monolayer.

A substrate shown in the electron micrograph in FIG. 13 on which half the surface was coated with a random colloidal coating and half with a compressed monolayer was prepared by:

(1) Forming a random colloidal coating of 0.5 micron polystyrene particles over the entire glass substrate surface using the method described in Example 1.
(2) Precoating a water surface with sodium lauryl sulfate which acts as a piston oil.
(3) Immersing half the substrate through the water interface as is shown in FIG. 4.
(4) Retracting the substrate from the water entraining the compressed monolayer on the surface.
(5) Drying the compressed monolayer to form a compressed coating on the half of the substrate which had been dipped.

FIG. 12 is an electron micrograph which shows the interface between the random colloidal and compressed coatings. The random colloidal coating appears as individual particles on the left half of the picture while the compressed layer appears as a solid mat of particles on the right. Because spaces between particles have been squeezed out, individual particles in the compressed coating are difficult to resolve.

EXAMPLE 4

A coating ten monolayers thick was prepared by sequentially repeating the method of Example 1. Immediately after the first compressed monolayer coating was formed, the substrate was baked to improve adhesion between the polymer particles and glass substrate. Baking was performed for 15 minutes at 50° C., which is a temperature below the point at which spheres melt and flow. Sequential monolayers were built up by repeating the steps of Example 1.

EXAMPLE 5

A compressed colloidal coating was prepared from a monolayer which was compressed with a physical barrier. The physically compressed layer was formed by:

(1) Spreading a monolayer of 2 micron spherical polystyrene particles on a water surface from a suspension of polystyrene spheres and hexane. The hexane is insoluble with water and floats and spreads on the surface when a drop is placed at the air-water interface. Polystyrene spheres placed in the hexane drop will not be substantially dissolved and will be carried across the water surface with the hexane. When the hexane evaporates a monolayer of polystyrene spheres is left on the water surface.

A hexane based sol was prepared by centrifuging an aqueous sol of polystyrene, decanting off the water and resuspending the particles in hexane. Particulate concentration in the hexane sol was approximately 1% solids. Within 5 minutes of hexane sol preparation, a drop was spread over the water surface. A dispersed monolayer was formed on the water surface after the hexane evaporated.

(2) The dispersed layer was compressed with two teflon rods which acted as a physical barrier pushing the layer together in a manner like that shown in FIG. 9.

(3) The compressed layer was transferred to a glass substrate using the technique illustrated in FIG. 10.

(4) The coating on the glass substrate was evaporated leaving a well adhered coating on the glass.

EXAMPLE 6

A monolayer of zeolite type ZK-5 was prepared using the following technique:

(1) Approximately 0.3 gm of dry ZK-5 zeolite particles were mixed with 20 cc of pentane. To this mixture approximately 0.5 cc of hexamethyldisilazane (HMDS) was added. This mixture was then ultrasonically agitated for 30 sec.

(2) A petri dish was filled with distilled water and the mixture prepared in step 1 was added dropwise to the surface. The pentane and HMDS were allowed to evaporate, leaving a monolayer of ZK-5 zeolite crystals trapped at the air water interface.

(3) A glass substrate onto which this monolayer was to be transferred was cleaned with nonionic detergent (Triton X-100) and rinsed with distilled water.

(4) The zeolite monolayer on the water surface was compressed with a dilute (200 ppm) aqueous solution of nonionic surfactant (Triton X-100). The surfactant solution was applied by placing a drop at the edge of the petri dish. Compression of the monolayer occurs as soon as the drop contacts the water surface.

(5) The compressed layer was lifted from the air water interface onto the glass slide prepared in step 3. Excess water was dried from the slide using a heat lamp leaving a film adhered zeolite monolayer

What is claimed is:

1. A method of producing a close packed coating of non-amphiphillic colloidal particles on a substrate comprising:

(a) forming a monolayer of said non-amphiphillic particles at a surface of a first liquid, wherein said monolayer includes only non-amphiphillic particles, (b) compressing said monolayer of said non-amphiphillic particles on said surface of said first liquid, (c) removing the compressed layer from said surface of said first liquid onto a substrate, and (d) drying and substrate.

2. The method of claim 1 wherein said forming step comprises immersing a random colloidal layer having voids into said first liquid such that said layer becomes trapped at said surface of said first liquid.

3. The method of claim 1 wherein said forming step comprises placing a second liquid including a suspension of particles onto said first liquid wherein said second liquid is immiscible with said first liquid, said second liquid and said suspension spreading over the surface of said first liquid.

4. The method of claim 1 wherein said compressing step comprises moving a mechanical barrier against said layer of particles so as to remove intervening spaces between particles.

5. The method of claim 1 wherein said compressing step comprises depositing a piston oil onto said surface of said first liquid so that said piston oil spreads across said surface compressing intervening spaces between particles.

6. The method of claim 5 where said forming step and said compressing step comprises a single step.

7. The method of claim 1 wherein compressing step produces a predetermined pattern of said monolayer of particles.

8. The method of claim 1 wherein said colloidal particles are monodisperse.

9. The method of claim 1 wherein said first liquid is water.

10. The method of claim 1 where the colloidal particles are between 0.1 and 5 $\mu$m.

11. The method of claim 1 wherein said colloidal particles are polymeric.

12. The method of claim 1 wherein said substrate is not water wet.

* * * * *